United States Patent [19]

Tobiasson

[11] 4,060,176

[45] Nov. 29, 1977

[54] CONTAINER LID-SPOON COMBINATION

[76] Inventor: John R. Tobiasson, 3315 Steiner St., No. 15, San Francisco, Calif. 94123

[21] Appl. No.: 603,095

[22] Filed: Aug. 8, 1975

[51] Int. Cl.[2] ..... B65D 51/24

[52] U.S. Cl. ..... 220/212; 30/328; 206/217; 215/100 R; 215/228; 229/1.5 C

[58] Field of Search ..... 215/DIG. 5, 228, 100 R; 206/216, 217; 229/1.5 B, 1.5 C; 220/212; 30/324, 326, 328

[56] References Cited

U.S. PATENT DOCUMENTS

| | | | |
|---|---|---|---|
| 1,625,335 | 4/1927 | Schneider | 229/1.5 C |
| 1,808,949 | 6/1931 | Flynn | 229/1.5 C |
| 1,834,085 | 12/1931 | Bloom | 229/1.5 C |
| 2,433,926 | 1/1948 | Sayre | 229/1.5 C |
| 2,598,987 | 6/1952 | Franzen | 229/1.5 C |
| 3,334,778 | 8/1967 | Saunders | 229/1.5 C |
| 3,487,974 | 1/1970 | Schovee | 220/212 |
| 3,557,995 | 1/1971 | Mirasol | 229/1.5 B |
| 3,679,093 | 7/1972 | Chang | 229/1.5 C |
| 3,730,372 | 5/1973 | Komendowski | 215/DIG. 5 |

*Primary Examiner*—Stephen P. Garbe
*Assistant Examiner*—Bruce H. Bernstein
*Attorney, Agent, or Firm*—C. Michael Zimmerman

[57] ABSTRACT

A food container lid is described which is convertible into a spoon for use in eating food from the container. A flap which is separable from the remainder of the lid is bendable at its base outward from the plane of the lid covering through approximately 180° so that such flap provides a spoon bowl and the lid otherwise provides a handle for manipulation of such spoon bowl. The base of the flap is positioned inwardly of the peripheral edge portion of the lid covering so that when the flap is bent outward it overlaps such peripheral edge portion which thereby provides rigidity to the connection between the spoon bowl and the handle. The lid covering and the base of the spoon bowl flap are foldable upon themselves with the covering encompassing the base in order to enhance such structural rigidity.

8 Claims, 6 Drawing Figures

CONTAINER LID-SPOON COMBINATION

BACKGROUND OF THE INVENTION

The present invention relates to a food container lid which is convertible into a spoon for use in eating food from the container, and more particularly, to such a combined lid and spoon which while being quite simple in construction provides a spoon with a rigidly connected handle.

Because certain foods, such as ice cream, yogurt, etc., are now commonly sold in individual serving cartons for immediate use, various arrangements have been designed for including a spoon along with the carton when it is sold. In general, the only commercially practical arrangements to date have required that a separate spoon, such as of wood, be provided for this purpose. While many different designs of a combined lid-spoon have been proposed, none have been both sufficiently inexpensive and effective for adoption.

SUMMARY OF THE INVENTION

The present invention provides a combined container lid and spoon which is sufficiently inexpensive to manufacture and effective for its purpose to be commercially acceptable. In basic terms, the container lid-spoon combination comprises a removable covering for the mouth of the container, and a flap at the midportion of such covering having an edge contour corresponding to that of a bowl of a spoon and being permanently secured to the covering at the base of such edge contour. As one salient feature of the invention, the flap is bendable at its base outward from the plane of the covering through approximately 180° so that such flap provides a spoon bowl which projects from the covering. The covering is then usable as a handle for manipulation of the spoon bowl. Most desirably, the base of the spoon bowl contour is positioned inwardly of the peripheral edge portion of the covering so that when the flap is bent outward from the covering through 180° it will overlap the peripheral edge portion of the covering. Also it is most desirable that the covering and the base of such flap are foldable upon themselves at the flap base with the covering encompassing the base. The resulting fold line in the spoon base and the fact that the base is supported from underneath by the peripheral edge portion of the covering will provide the structural rigidity to the connection between the spoon bowl and the handle required for the spoon to be able to withstand spooning action and support food. This structural rigidity is enhanced when the peripheral edge portion of the covering includes a rim channel for sealing the covering over the mouth of a container. When the spoon flap overlaps the periphery of the covering, the rim channel will add structural rigidity to the support for the spoon base provided by it.

While the flap of the food container can be provided by material which is in addition to that needed for the covering, most desirably the flap is provided by a midportion of the covering which is separable from the remainder thereof so that the material body of the container lid provides both the spoon bowl and the handle.

The above features and advantages, as well as additional features and advantages, will be described or will become apparent from the following more detailed description of the preferred embodiment.

BRIEF DESCRIPTION OF THE DRAWING

With reference to the accompanying single sheet of drawing.

DETAILED DESCRIPTION OF THE PREFERRED EMBODIMENTS

Figure 1:
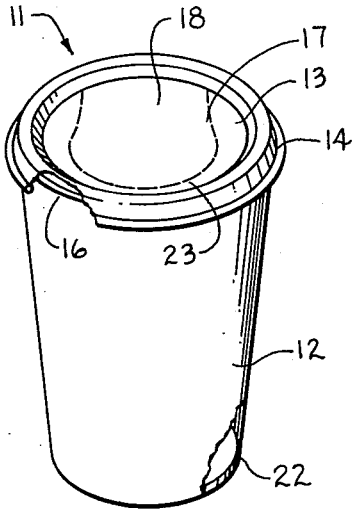
FIG. 1 is an isometric view of a typical single serving food container over the mouth of which is applied a preferred embodiment of the combined container lid-spoon of the invention.

FIG. 1 illustrates a preferred embodiment of a container lid-spoon combination of the invention, generally referred to by the reference numeral 11, sealing the mouth of a conventional, individual food serving container 12. Individual food serving containers such as the container 12 and the lids therefor are often made either from paperboard or from a sheet material which includes a synthetic polymer. The instant invention is easily made from a synthetic polymer sheet material. In this connection, container lids are most often formed from such a material by a thermoforming process. That is, such lids are often formed by heating such a sheet material and then drawing it into the desired shape prior to the time it cools. While the synthetic polymer is generally a vinyl, such as polyvinyl chloride, or a styrene, such as high impact polystyrene, acrylics and olefins are also suitable for the material of such lids as is known.

The lid 11 includes a covering 13 which closes the mouth of the container in a removable fashion. As illustrated, the peripheral edge portion of the covering rim channel 14 which circumscribes the body of such covering. The channel 14 is easily formed as a part of the lid when it is made by a thermoforming process. Such channel is adapted to receive a complementary lip 16 around the mouth of the container in order to seal such covering over the mouth.

Figure 2:
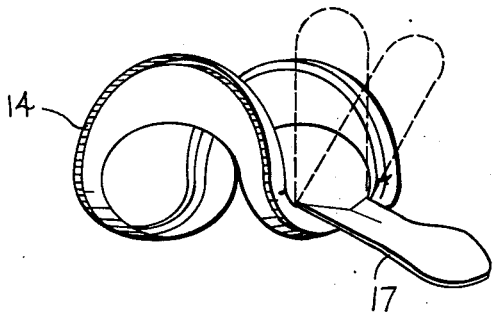
FIG. 2 is an isometric view of the combined container lid-spoon showing it being converted from lid to spoon form with phantom lines illustrating intermediary positions of the spoon bowl forming flap during conversion.
Figure 4:
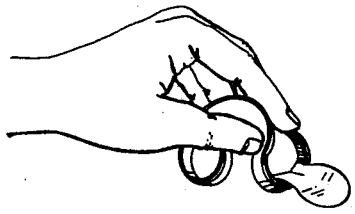
FIG. 4 is an isometric view illustrating an appropriate way of holding the combined container lid-spoon for manipulation when it is in spoon form.

In keeping with the invention, a flap 17 is provided at the mid-portion of the covering. As illustrated, the flap 17 has a free edge contour which generally corresponds to that of a bowl of a spoon and is permanently secured to the covering at the base 18 of the spoon bowl edge contour. As illustrated in FIG. 2, the flap 17 is bendable at the base 18 outward from the covering through approximately 180° so that it projects from the covering. The result is that the flap provides a spoon bowl which projects from the covering. The covering is then usable as a handle as illustrated in FIG. 4 for manipulation of the spoon bowl.

Figure 3:
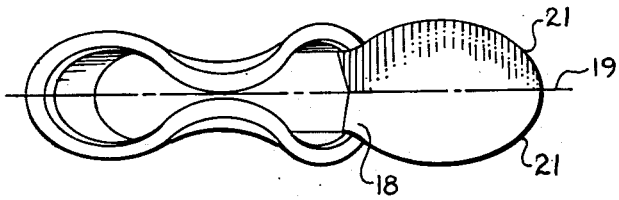
FIG. 3 is an elevation view of the combination spoon-lid in spoon form.

As a particularly salient feature of the instant invention, it includes an arrangement which provides structural rigidity to the connection between the spoon bowl and the handle. In this connection, it should be noted that lack of structural rigidity at such a connection has been one of the primary reasons that earlier container lid-spoon combinations have not been acceptable. It will be recognized that a reliable rigid connection between the spoon bowl and covering handle is necessary if the spoon is to be capable of withstanding spooning action and supporting food to be transported. To this end, as is shown for example in FIG. 3, the base 18 of the spoon bowl is secured to the covering inwardly of its peripheral rim channel. Thus, when the flap is bent outward from the covering through 180°, it overlaps such peripheral rim channel. Moreover, when the covering is converted into a handle for the spoon, its opposite edges are brought together in order to form the handle. That is, both the covering and the base are folded upon themselves about coextensive fold lines which extend from the longitudinal axis 19 of the spoon bowl contour provided by the flap, with the covering encompassing the base of the flap. The underneath side of the covering, i.e., the inner side when the lid is on a container, becomes the outer convex side of the spoon handle.

The fold lines applied both to the base and to the peripheral edge portion of the covering, together with the fact that the peripheral edge portion of the covering is overlaid by the base, provide enhanced structural rigidity to the connection between the spoon bowl and the handle. It has been found that this construction can be relied on to provide the structural rigidity required between the spoon bowl and the handle for both spooning action and food transport. It should be noted that this structural rigidity is increased by the provision of the rim channel 14. That is, the rim channel geometry strengthens the peripheral edge portion of the covering to resist bending of such peripheral edge portion under the pressure of the spoon bowl base when the spoon bowl is in use.

As another salient feature of the instant invention, the spoon bowl is designed to facilitate the complete removal of food from the container 12. In this connection, it will be recognized that often it is difficult to remove food from the very bottom of a single serving food carton, particularly at the edges. To this end, the curvature of the front of the spoon bowl edge, i.e., that portion of the spoon bowl edge corner between the markings 21 in FIG. 3, conforms essentially to the curvature of the circular joint line 22 (FIG. 1) at which the bottom surface of the food container meets the container side wall. Thus, when one inserts the spoon into the container and slides the same along the bottom to the circular joint line 22, all of the food at such joint line will end up on the spoon. In this connection, it should be noted that whereas the curvature applied to the spoon by the previously mentioned folding will add the structural strength necessary to prevent the same from folding downward and losing food, the tip of the spoon can still be folded upward under pressure. Thus, when a user inserts the same to the bottom of a container, the spoon tip will conform to the container in order for it to be inserted beneath any food at the container bottom joint line.

Most desirably, the flap 11 is provided by a mid-portion of the covering which is partially from the remainder thereof so that the material of the container lid provides both the spoon bowl and the handle, as well as the required covering for the mouth of the container before the spoon is to be used. To this end, the body of the covering of the embodiment of FIGS. 1–4 is provided as a continuous sheet of material having a score line 23 at its mid-portion following the desired spoon bowl edge contour. The score line is sufficiently deep within the material to make such material tearable along such score line. Thus, a user need only punch out the mid-portion of the covering to provide the flap which becomes the spoon bowl. The score line 23 is easily provided during the making of the lid by stamping or the like.

Figure 5:
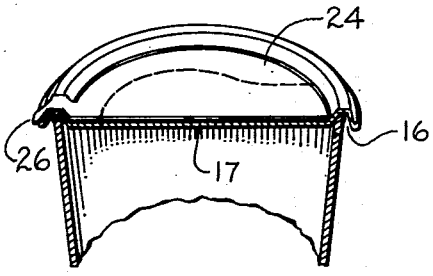
FIG. 5 is an isometric sectional view illustrating a second preferred embodiment of the invention.

Rather than being provided as a punch-out as described, the flap 17 can also be provided as a piece which is already separated from the remainder of the covering along the spoon bowl edge contour. FIG. 5 illustrates an alternate embodiment of the invention in which the flap is so provided. That is, in FIG. 5 the flap 17 is separated from the remainder of the lid covering material along the spoon bowl edge contour when the lid is manufactured, rather than by the user. A protective covering sheet 24 is then laminated to the exterior surface of the covering to provide the required seal for the food. The sheet 24 is most desirably peelable from the covering 13 to expose its mid-portion and thereby expose the flap. In this connection, a tab 26 is provided to facilitate such peeling. It should be noted that the covering sheet 24 not only provides the requisite lid sealing, but it also protects the upper surface of the covering sheet from dirt and the like. The result is that both surfaces of the flap 17 are protected from dirt prior to the time the flap is actually used.

Figure 6:
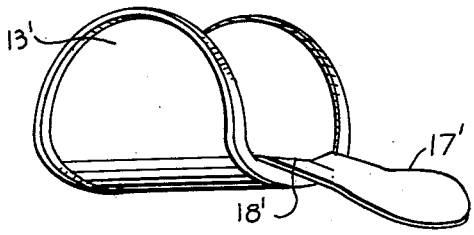
FIG. 6 is an isometric view of a third preferred embodiment of the invention.

FIG. 6 illustrates a third manner in which the flap of the invention can be provided. As illustrated, the flap 17' is provided as a piece which is separate from and in addition to the covering 13', which piece lies parallel with the underneath side of the covering when the covering closes the mouth of a container. In use, the flap is bent through approximately 180° as in the prior embodiments. However, in order to provide support of the flap base 18' by the peripheral edge portion of the covering, the covering is folded with the side thereof which is exposed when the lid is on a container, as the outer convex side when the lid is a spoon.

While it is contemplated that the arrangement of FIG. 6 is within the broad scope of the invention, it will be recognized that additional material and more extensive manufacturing procedure is required for the embodiment of FIG. 6 than the earlier described embodiments. The embodiments of FIGS. 5 and 6 otherwise conform to the embodiment of FIGS. 1–4 and therefore will not be described in more detail.

While the invention has been described in connection with preferred embodiments thereof, it will be appreciated by those skilled in the art that various changes and modifications can be made without departing from the spirit of the invention. It is therefore intended that the coverage afforded applicant be limited only by the terms of the claims and their equivalents.

I claim:

1. A container lid convertible between the first position to function as a lid for closing the top of a container for food and a second position wherein it is folded to function as a spoon for removing and eating the contents of the container, comprising:

in its first position a generally disc-shaped, snap-on food container lid comprising a generally discoidal removable planar covering for the mouth of said container, and a peripheral edge portion defining a rim channel circumscribing the body of said covering for receiving a complimentary lip on said container, said rim channel having an inner and an outer edge; a planar flap at the mid-portion of said covering having an edge contour generally corresponding to that of the planar projection of a bowl of a spoon with the base of said spoon bowl edge contour permanently secured to said covering along a straight fold line that extends between two points at least closely adjacent said inner edge of said rim channel of said covering; and in its second position a spoon having said flap bent on said straight fold line at said base outward from said covering through approximately 180° from said first position so as to be overlapping said rim channel; said flap projecting outwardly from said covering and said rim channel for a major portion of its length as measured along the longitudinal axis of said flap perpendicular to said straight fold line; both said covering and said rim channel being folded upon themselves about the longitudinal axis of said flap so that said flap is curved about its longitudinal axis to form a spoon bowl, so that the fold line and the corresponding arcuate shape of said rim channel and said covering overlaid by said flap provide structural rigidity to the connection between said spoon bowl and said handle, and said rim channel strengthens said peripheral edge portion to resist bending under pressure of said spoon bowl when said spoon bowl is in use.

2. The food container lid of claim 1 in combination with a food container having a bottom surface meeting a side wall at a circular joint line, the curvature of the front of said spoon bowl edge contour conforming essentially to the curvature of said circular joint line to facilitate removal with said spoon of food on said container bottom surface adjacent said joint line.

3. The food container lid of claim 1 wherein said flap is provided as a piece separate except for said base from said covering which lies generally parallel with said covering when said covering closes the mouth of a container in said first position.

4. The food container lid of claim 1 wherein said flap is provided by a mid-portion of said covering which is partially separable from the remainder thereof, so that in said second position, said covering has a central opening with the material of said first position container lid then providing both said spoon bowl and said handle in said second position.

5. The food container lid of claim 4 further including a protective covering sheet laminated to the exterior surface of said covering and peelable therefrom to expose said covering mid-portion which provides said flap.

6. The food container lid of claim 4 wherein said covering is a continuous sheet of material having a score line at its mid-portion following said spoon bowl edge contour, said material being tearable along said score line to provide said flap.

7. The food container lid of claim 1 wherein said covering is made from a thermoformable sheet material which includes a synthetic polymer.

8. The food container lid of claim 7 wherein said synthetic polymer is selected from the group of resins consisting of vinyls, acrylics, olefins and styrenes.

* * * * *